US006511039B1

(12) United States Patent
Nash

(10) Patent No.: US 6,511,039 B1
(45) Date of Patent: Jan. 28, 2003

(54) COLLAPSIBLE NOTEBOOK COMPUTER PLATFORM

(75) Inventor: James E. Nash, Bloomington, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 09/636,191

(22) Filed: Aug. 10, 2000

(51) Int. Cl.[7] ..... F16M 1/00
(52) U.S. Cl. ..... 248/678; 248/346.07
(58) Field of Search ..... 248/678, 346.07, 248/924, 448, 118.3, 118, 289.11, 298.1, 346.01, 918; 108/50.1, 50.2, 31

(56) References Cited

U.S. PATENT DOCUMENTS

| | | | | |
|---|---|---|---|---|
| 5,209,452 A | | 5/1993 | Goldberg | 248/676 |
| 5,228,655 A | | 7/1993 | Garcia et al. | 248/118 |
| 5,337,985 A | | 8/1994 | Hale | 248/174 |
| 5,490,039 A | | 2/1996 | Helms | 361/683 |
| 5,503,361 A | | 4/1996 | Kan-O et al. | 248/688 |
| 5,508,084 A | | 4/1996 | Reeves et al. | 428/172 |
| 5,511,758 A | | 4/1996 | Hsu | 248/461 |
| 5,553,824 A | | 9/1996 | Dutra, Jr. | 248/346.07 |
| 5,607,054 A | | 3/1997 | Hollingsworth | 206/320 |
| 5,655,743 A | | 8/1997 | Gillis | 248/346.01 |
| 5,769,369 A | * | 6/1998 | Meinel | 248/176.1 |
| 5,901,934 A | | 5/1999 | Wilson | 248/918 |
| 5,915,661 A | | 6/1999 | Silverman et al. | 248/465.1 |
| 6,003,446 A | | 12/1999 | Leibowitz | 108/43 |
| 6,105,508 A | * | 8/2000 | Ryburg | 108/42 |
| 6,123,309 A | * | 9/2000 | Sage | 248/316.1 |

* cited by examiner

*Primary Examiner*—Ramon O. Ramirez
*Assistant Examiner*—Kofi Schulterbrandt
(74) *Attorney, Agent, or Firm*—George W. Jonas

(57) ABSTRACT

A collapsible computer platform assembly for use with a notebook or portable computer, wherein the computer platform assembly comprises a platform having a first surface and an opposite second surface, and a support arm assembly for supporting the bottom surface of a computer. The support arm assembly comprises at least one base portion extending from the second surface of the platform and at least one adjustable arm assembly connected to the at least one base portion. The present invention also includes within its scope a platform assembly that is slideably connected to the base portion. The adjustable arm assembly may be rotatable relative to the platform. The platform assembly may also include a mousing surface or a wrist rest pad on its first surface. It is further understood that the support arm assembly may further comprise at least one leg extending from at least one of the adjustable arm assembly and the base portion. Also provided is a method of supporting a portable computer relative to the surface on which the computer is placed with a computer platform assembly of the type described above.

13 Claims, 9 Drawing Sheets

COLLAPSIBLE NOTEBOOK COMPUTER PLATFORM

TECHNICAL FIELD

The present invention relates to notebook computers. More particularly, the present invention provides a collapsible platform for supporting a notebook computer at an angle relative to a base surface.

BACKGROUND OF THE INVENTION

In recent years, notebook computers have become less expensive, lighter, and more powerful. At the same time, there is a trend toward smaller offices with less room for a docking station and separate monitor. In addition, there has been an increase in "on the go" use of notebook computers, such as for business travelers and telecommuters who use their computers in multiple locations. As a result, the popularity of notebook computers has greatly increased.

One of the aspects of notebook computers that many users find cumbersome is the variety of cursor control devices that have been used to replace the standard mouse. Examples of these devices include trackballs and small pegs or joysticks placed in the central area of the notebook computer keyboard that can be manipulated by the user's thumb or fingers to achieve the same functions as an external mouse. However, many users prefer to instead use the more conventional type of mouse that may be connected to the external mouse port of the notebook computer. In this way, the user can more closely simulate the arrangement of a desktop computer, where the mouse is manipulated as a separate device from the keyboard.

Ergonomic issues for computer users have been well documented for many years, including the potential health problems associated with computers. Many of these potential problems are related to improper positioning of the computer screen, keyboard, and mouse relative to the user. Various products have thus been designed to improve the ergonomics for users by repositioning certain computer components, thereby reducing the associated health problems.

Currently, there are various products available to position a notebook computer at an angle relative to the surface on which it is placed, thereby bringing a user's wrists to a more comfortable neutral position when using the keyboard and also raising the screen to allow for a more upright head position. Examples of these are described in U.S. Pat. No. 5,209,452 (Goldberg) and U.S. Pat. No. 5,337,985 (Hale), which both show devices that can position a notebook computer at an angle relative to the user. There are also apparatuses available that can position a notebook computer at a desirable angle for the user while providing a properly angled mousing surface for users who wish to use an external mouse. One example of such an apparatus is commercially available from the Minnesota Mining and Manufacturing Company of St. Paul, Minn., as the Adjustable Notebook Platform Model Number ANP 560 and is illustrated in FIG. 1. This computer device provides an angled platform for positioning both a notebook computer and an external mouse on the same planar surface. There is, however, a need for an ergonomic apparatus for use with a notebook computer and external mouse that is sufficiently compact and lightweight to be easily portable for the user.

SUMMARY OF THE INVENTION

In one aspect of this invention a collapsible computer platform assembly for use with a notebook or portable computer is provided, wherein the computer platform assembly comprises a platform having a first surface and an opposite second surface, and a support arm assembly for supporting the bottom surface of a computer. The support arm assembly comprises at least one base portion extending from the second surface of the platform and at least one adjustable arm assembly connected to the at least one base portion.

The present invention also includes within its scope a platform assembly that is slideably connected to the base portion. The adjustable arm assembly may be rotatable relative to the platform. The platform assembly may also include a mousing surface or a wrist rest pad on its first surface. It is further understood that the support arm assembly may further comprise at least one leg extending from at least one of the adjustable arm assembly and the base portion.

The present invention further includes within its scope a collapsible platform assembly comprising a platform having a first surface and an opposite second surface and a support arm assembly for supporting the bottom surface of a computer, wherein the support arm assembly comprises a first base portion extending from the second surface of the platform, a second base portion spaced from the first base portion and extending from the second surface of the platform, a first adjustable arm assembly connected to the first base portion, a second adjustable arm assembly connected to the second base portion, and at least one support member connected to the first and second adjustable arm assemblies. The first adjustable arm assembly, the second adjustable arm assembly, and the at least one support member may be rotatable relative to the platform.

Also provided is a method of supporting a portable computer at an angle relative to the surface on which the computer is placed, comprising the steps of: (a) providing a collapsible platform assembly for supporting a portable computer, the assembly comprising a platform having a first surface and an opposite second surface, and a support arm assembly for supporting the bottom surface of a computer, the support arm assembly comprising at least one base portion extending from the second surface of the platform and at least one adjustable arm assembly connected to the at least one base portion, (b) providing a portable computer, and (c) positioning the portable computer on the platform assembly so that a bottom surface of the computer rests on at least a portion of the adjustable arm assembly.

BRIEF DESCRIPTION OF THE DRAWINGS

The present invention will be further explained with reference to the appended Figures, wherein like structure is referred to by like numerals throughout the several views, and wherein.

DETAILED DESCRIPTION OF THE PREFERRED EMBODIMENTS

The collapsible computer platform assembly of the present invention is designed to provide an ergonomic device for use with a notebook computer that can also be easily used with an external mouse. In addition, this assembly is intended to be compact in its overall size so that it can fit easily into a notebook computer bag alongside a computer.

The term "notebook computer", as used throughout this description, includes any of the various types of portable computers and electronic devices available. This may include, for example, laptop computers, notebook computers, palm-top computers, word processors, pocket computers, electronic personal organizers, microcomputers, and electronic writing and drawing pads for pen based computing. The term "notebook computer" is also intended to encompass other portable devices that are now in use or will later be developed for similar applications as the devices listed above.

Figure 1:
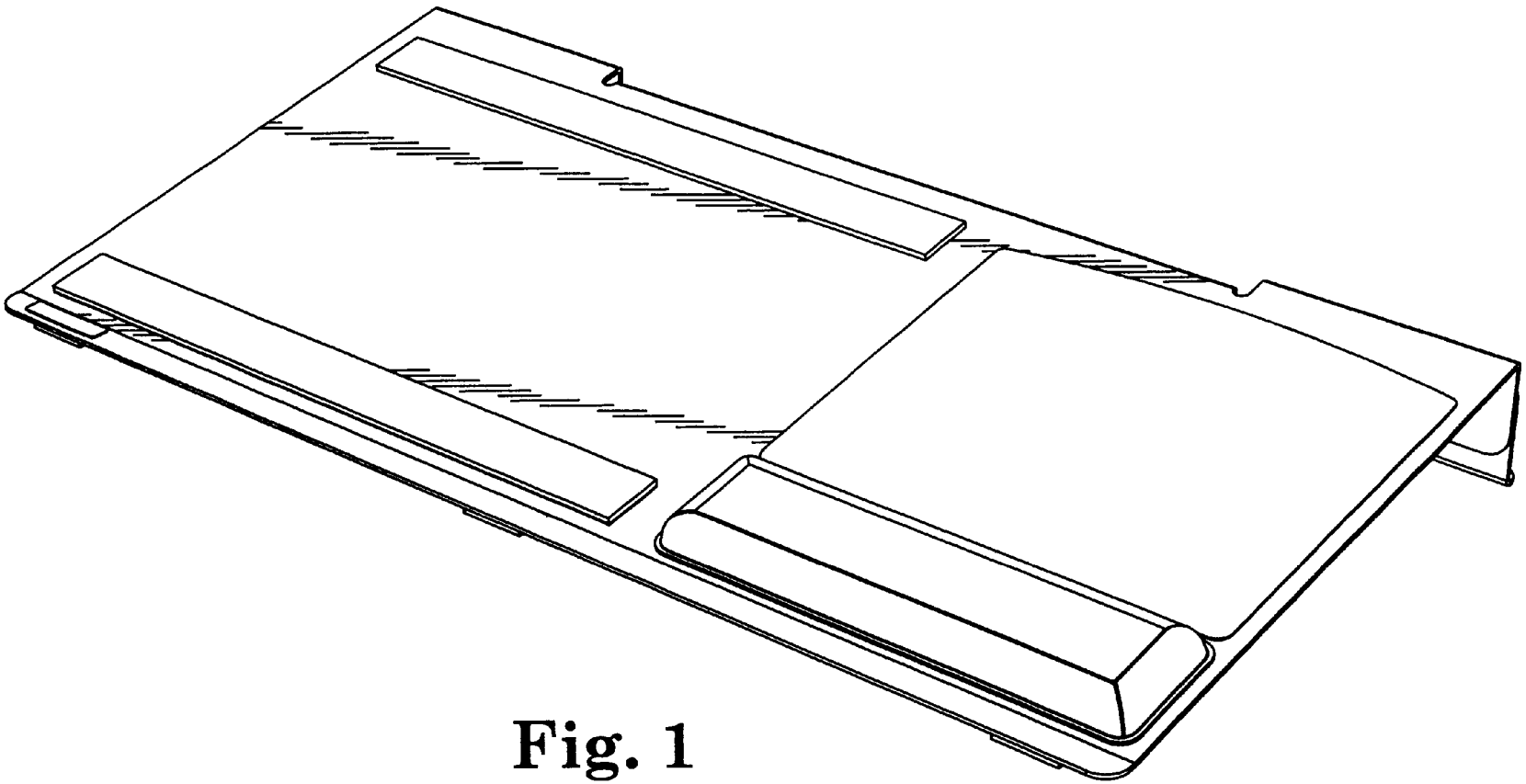
Fig. 1 PRIOR ART
FIG. 1 is an isometric view of a prior art notebook computer platform.
Figure 2:
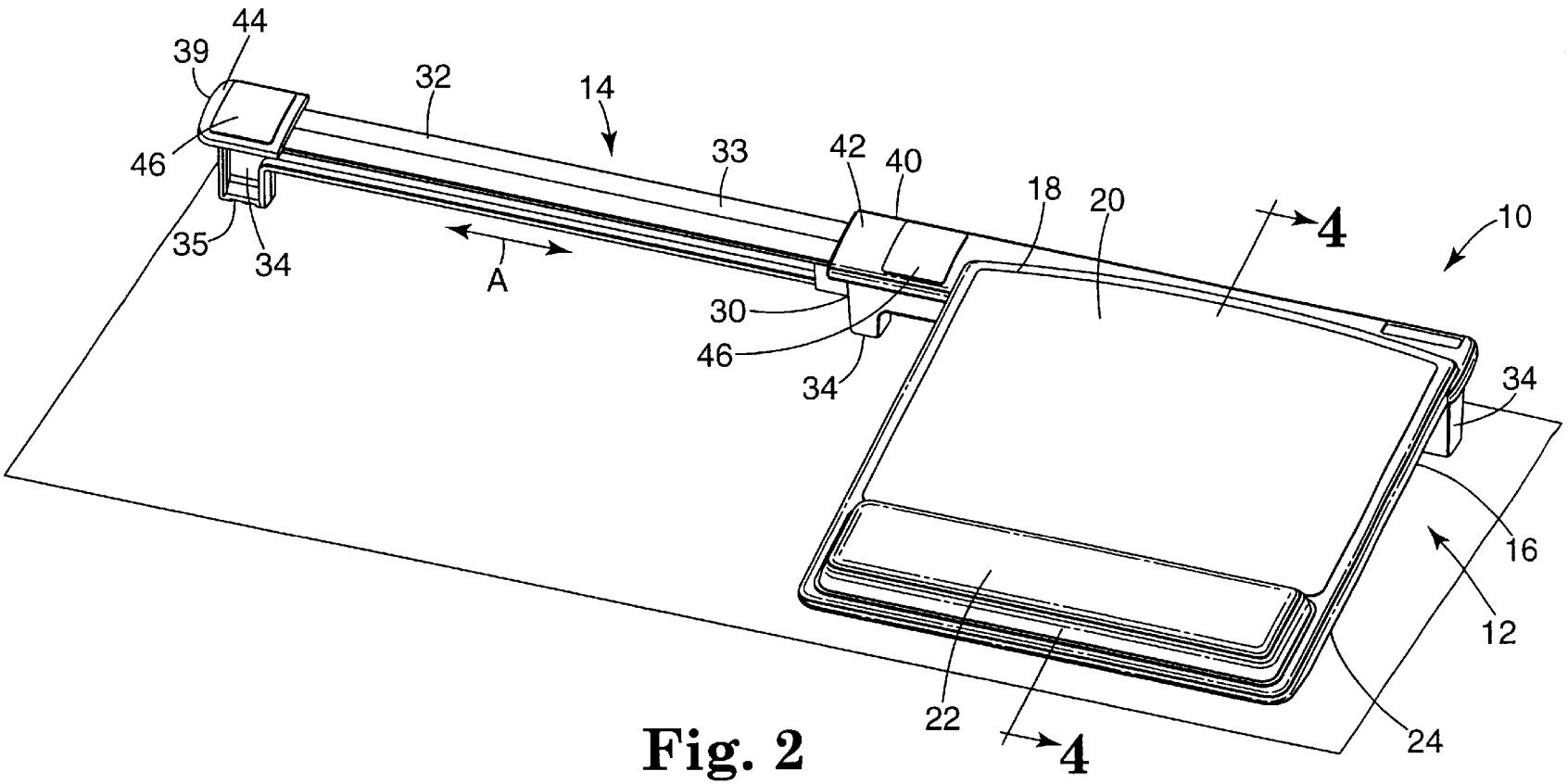
FIG. 2 is an isometric view of one embodiment of a collapsible computer platform assembly in accordance with the present invention, wherein the adjustable support arm is in its extended position.
Figure 3:
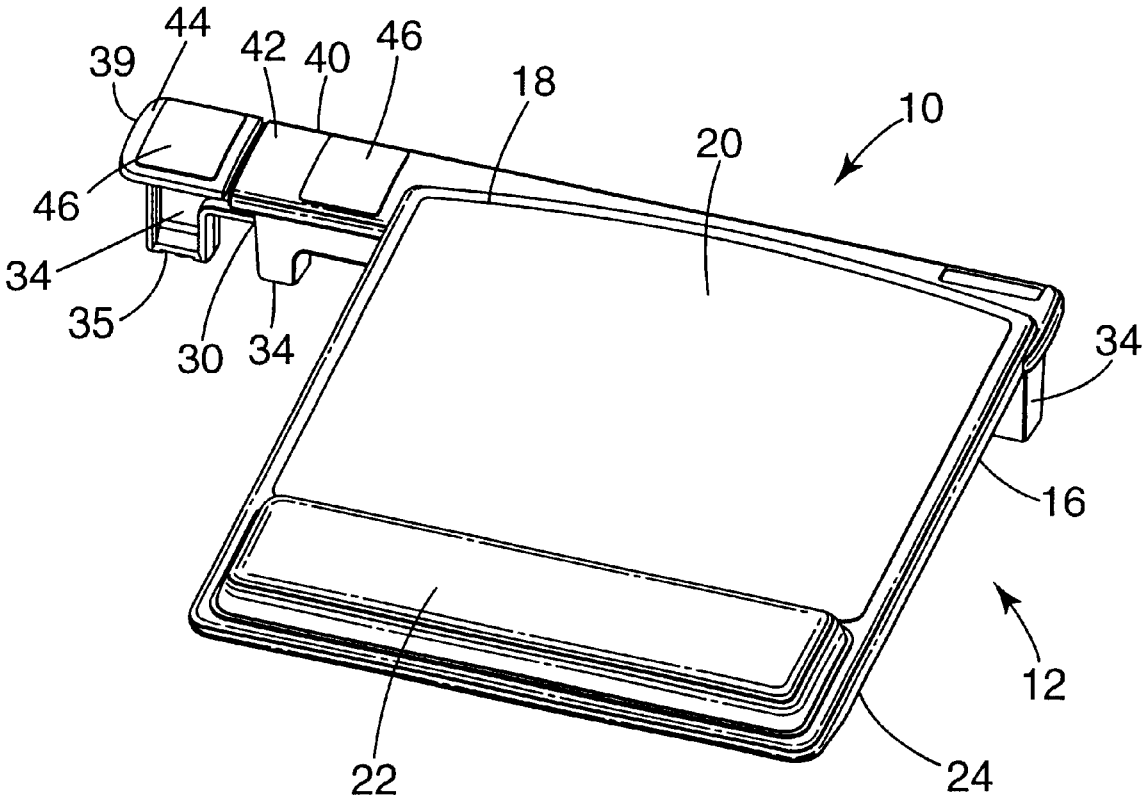
FIG. 3 is an isometric view of the computer platform assembly of FIG. 2, wherein the adjustable support arm is in its retracted position.

Referring now to the Figures, and initially to FIGS. 2 and 3, one preferred embodiment of a collapsible platform assembly 10 for notebook or portable computers is illustrated, which basic components comprise a mousing assembly 12 and an adjustable support arm assembly 14. In this embodiment, mousing assembly 12 generally comprises a mousing platform 16 having a first surface 18, which preferably includes both a mousing surface 20 and a wrist rest pad 22, and an opposite second surface 24 from which adjustable support arm assembly 14 is attached, as further described below. FIG. 2 illustrates platform assembly 10 with the support arm assembly 14 in its extended position, while FIG. 3 illustrates the same assembly with the support arm assembly 14 is in its retracted position.

One preferred embodiment of support arm assembly 14 preferably comprises a base portion 30 that may be attached or connected to second surface 24 of the mousing platform 16, or may be molded as an integrated portion of the mousing platform 16. Assembly 14 further includes a sliding arm 32 that is designed to move in sliding engagement with the base portion 30 between its extended position shown in FIG. 2 and its retracted position shown in FIG. 3.

Figure 4:
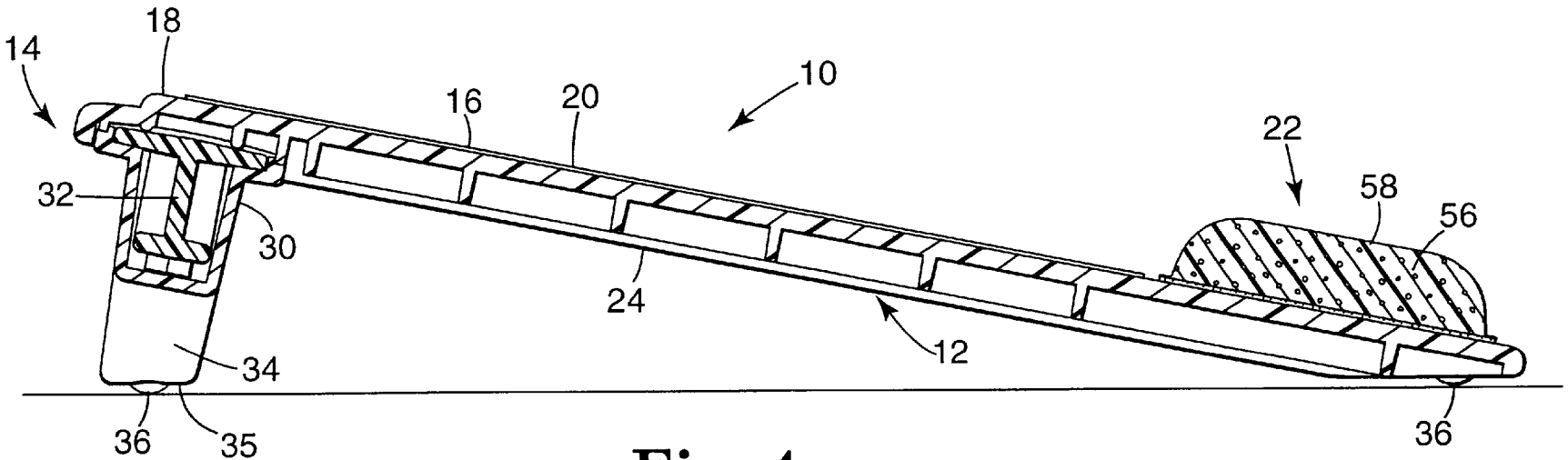
FIG. 4 is a across-sectional view of the adjustable support arm assembly of FIG. 2 taken at section lines 4—4.

One preferred embodiment of support arm assembly 14 is illustrated in FIG. 4, which is a cross-sectional view taken at section line 4—4 of FIG. 2. Support arm assembly 14 comprises a base portion 30 having a generally U-shaped cross section for receiving the generally I-shaped cross section of sliding arm 32. However, it is understood that any number of shapes for the base portion 30 and sliding arm 32 may be used, provided that the sliding arm 32 can move relatively easily along or within the base portion 30 in the longitudinal direction (shown as direction 'A' in FIG. 2) for extending and retracting. It is also preferred that the base portion 30 and sliding arm 32 have relatively close tolerances to allow minimal movement between the two portions in the lateral direction.

Referring again to FIGS. 2 and 3, sliding arm 32 comprises a top surface 33 that is at least partially exposed when arm 32 is extended. Sliding arm 32 may optionally include a skid-resistant material (not shown), such as a textured tape, on at least a portion of its top surface 33. This skid-resistant material can help prevent a computer from slipping off the sliding portion 32 when in use and may be any suitable material that provides friction between the material and the bottom of a notebook computer.

Sliding arm 32 may also be provided with a support plate 39 on a portion of its top surface 33, and mousing platform 16 may be provided with an extension portion 40. In this illustration, extension portion 40 has a top surface 42 that is essentially coplanar with the first surface 18 of mousing platform 16. Further, plate 39 preferably is sufficiently thick so that its top surface 44 and the top surface 42 of the extension portion 40 are in the same plane. In other words, top surface 44 of plate 39 and the top surface 42 of extension portion 40 would be at the same distance from the surface on which the platform assembly 10 is placed when in use. The fact that these surfaces are preferably coplanar is useful for keeping a notebook computer level when placed thereon, since the top left corner of the computer can rest on plate 39 and the top right corner of the computer can rest on extension piece 40, while the bottom edge of the computer can rest on a table or desk surface. In addition, surfaces 42, 44 can be provided with skid-resistant pads 46, which may be 1/16inch (0.16 cm) urethane pads, or may be any other suitable material of an appropriate thickness for providing friction between the pad surface and the bottom of a notebook computer.

Sliding arm 32 preferably further includes a mechanical stop (not shown) to prevent the user from extending the sliding arm 32 beyond the point where it would become disconnected from base portion 30. The mechanical stop may also provide the user with an indication that the fully extended position of the sliding arm 32 has been reached. Depending on the size of the notebook computer, the user may or may not choose to fully extend the sliding arm 32 when in use. For example, a user may choose to only partially extend arm 32 if a compact notebook computer is being used.

Adjustable support arm assembly 14 preferably further includes multiple legs 34 which extend from both the base portion 30 and the sliding arm 32 to support the platform assembly 10 above the surface on which it is placed. In this embodiment, two legs 34 extend from base portion 30 and one leg 34 extends from sliding arm 32. It is understood that more or less legs may be used, depending on the desired arrangement of components and the required amount of structural support for the computer. Further, because legs 34 help to position the platform assembly 10 at a certain relationship with respect to the surface on which it is placed, the length of legs 34 and the angle at which they are positioned should be chosen accordingly. In one preferred embodiment, the length of the legs are approximately 1.5 inches (3.81 cm) long to produce a platform angle of approximately 12 degrees from horizontal. However, it is understood that the legs may be longer or shorter than 1.5 inches (3.81 cm), thereby producing platform angles greater or less than 12 degrees from horizontal, respectively.

Each leg 34 has a bottom surface 35 that may optionally be provided with at least one pad 36. Pads 36 can provide various advantages to the user. For example, pads 36 may provide a skid-resistant surface that keeps assembly 10 more stable when placed on a surface. In this case, pads 36 should be selected to provide adequate friction between each pad 36 and the surface with which it will come in contact, such as a desktop. In addition, pads 36 can be used to prevent damage such as abrasion, marring, or staining of the surface on which the assembly 10 is placed. Thus, one preferred material from which pads 36 may be made is urethane, but may include a number of other suitable materials, such as PVC, thermoplastics, rubber, or the like.

When pads 36 are used, they are preferably attached to bottom surface 35 of legs 34 with an adhesive or adhesive tape placed between bottom surface 35 and pads 36. However, it is also possible that the bottom leg surface 35 be textured in some way to provide the desired level of skid-resistance between legs 34 and the surface on which they are placed. In addition, it may be desirable for legs 34 to be made of a material that provides skid-resistance and protective properties so that pads 36 are unnecessary.

Figure 5:
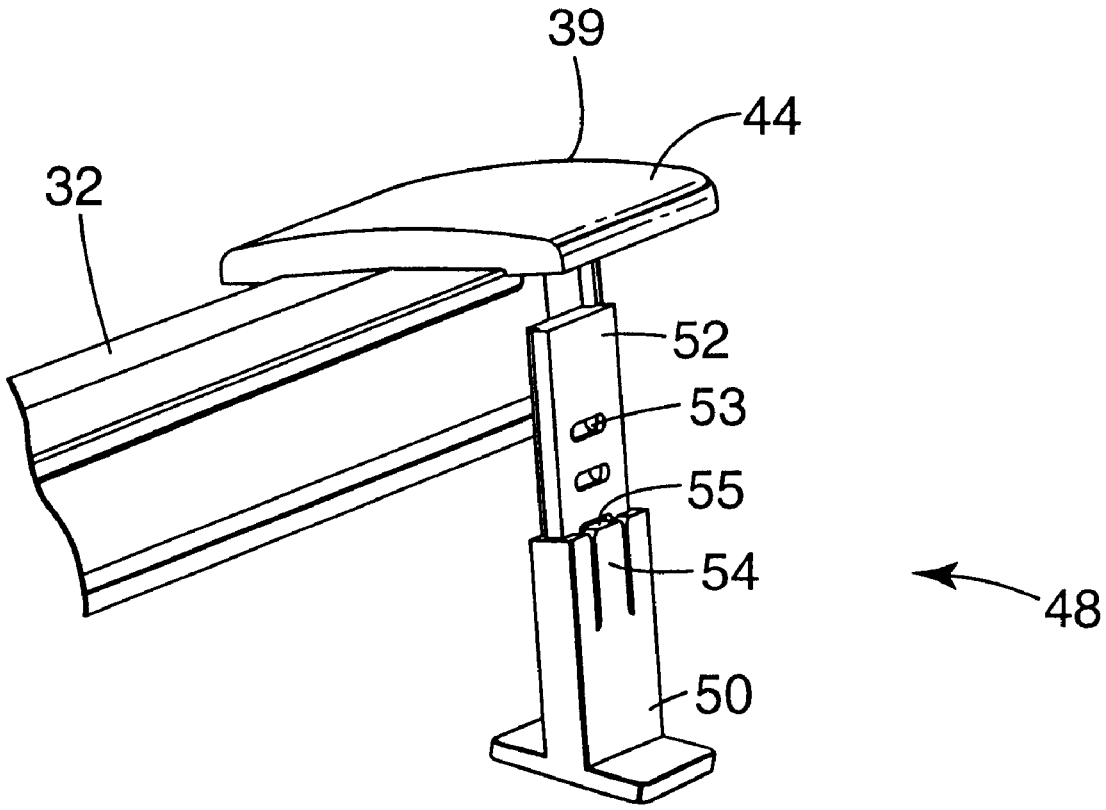
FIG. 5 is a partial isometric view of one embodiment of an adjustable leg assembly.

Legs 34 may be simple, nonadjustable components as shown in FIGS. 2 and 3. However, legs 34 may instead be adjustable so that the user can vary the leg length, thereby changing the relationship of assembly 10 relative to the surface on which it is placed. This can give the user some flexibility to position the assembly 10 at an angle that provides maximum comfort. One example of such a leg is shown in FIG. 5 as adjustable leg 48. Leg 48 includes a leg base 50 having a flexible portion 54 from which tab 55 extends, and a slotted member 52 having multiple slots 53 along its length for receiving tab 55. Leg base 50 can slide along the length of slotted member 52 to adjust the length of leg 48. To lengthen leg 48, leg base 50 is pulled downward relative to slotted member 52 until flexible portion 54 flexes outwardly and tab 55 becomes disengaged with the slot 53 with which it is engaged. Leg base 50 continues to be pushed in a downward direction until tab 55 engages with another slot 53 further down the length of slotted member 52. Similarly, leg base 50 may be pushed upward relative to slotted member 52 to shorten leg 48. Thus, flexible portion 54 should be rigid enough so that tab 55 stays engaged with a slot 53 when a computer is placed on assembly 10, but flexible enough that it can be pulled or pushed relatively easily by the user to adjust the leg length.

Legs 34 are preferably fixed relative to the base portion 30 and the sliding arm 32. However, legs 34 may also be hinged at the point where they attach to the base portion 30 and sliding arm 32. In this way, legs 34 may be folded toward the mousing platform 16 to make the assembly 10 more compact for storage. Although hinged legs 34 would be appropriate for any arrangement of the assembly 10, this feature would typically be advantageous when legs 34 are relatively long.

While the preferred embodiment of assembly 10 includes multiple legs 34, it is understood that base portion 30 and sliding arm 32 may not include any legs. In this embodiment, the base portion 30 and sliding arm 32 may rest directly on the table or other surface on which the assembly 10 is placed. Alternatively, pads may be attached at various points along the bottom of the base portion 30 and sliding arm 32 to provide friction between the pads and the surface on which the assembly is placed and to prevent damage to the underlying surface.

Figure 6:
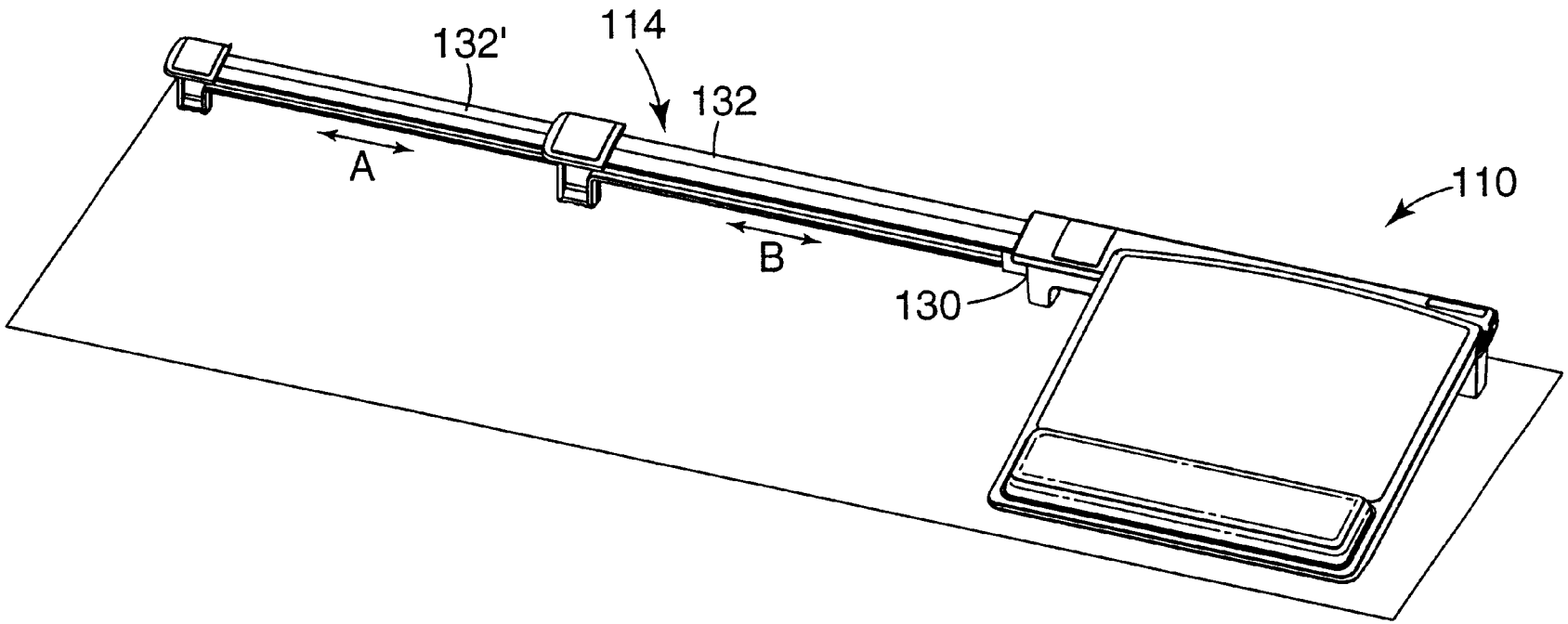
FIG. 6 is an isometric view of another embodiment of a collapsible computer platform assembly.

The platform assembly of the present invention may be provided with a adjustable arm assembly of the type described above, or may include any of a number of other adjustable arm assemblies. One alternative embodiment of a collapsible platform assembly 110 with an adjustable arm assembly 114 is illustrated in FIG. 6. Assembly 114 includes a base portion 130, a first sliding arm 132 that slides within base portion 130 (shown as direction 'B'), and a second sliding arm 132' that slides within first sliding arm 132 (shown as direction 'A') in a "telescoping" manner. This arrangement helps to keep the unit relatively compact when the sliding arms 132, 132' are retracted, but allows for the arm to be relatively long when both arms 132, 132' are extended. The user may choose to only extend one of the sliding arms when the full arm length is not needed, or to only partially extend one or both of the arms. It is also understood that more than two sliding arms may be provided, where additional arms would fit inside the other arms to provide the same type of "telescoping" ability described above.

Figure 7:
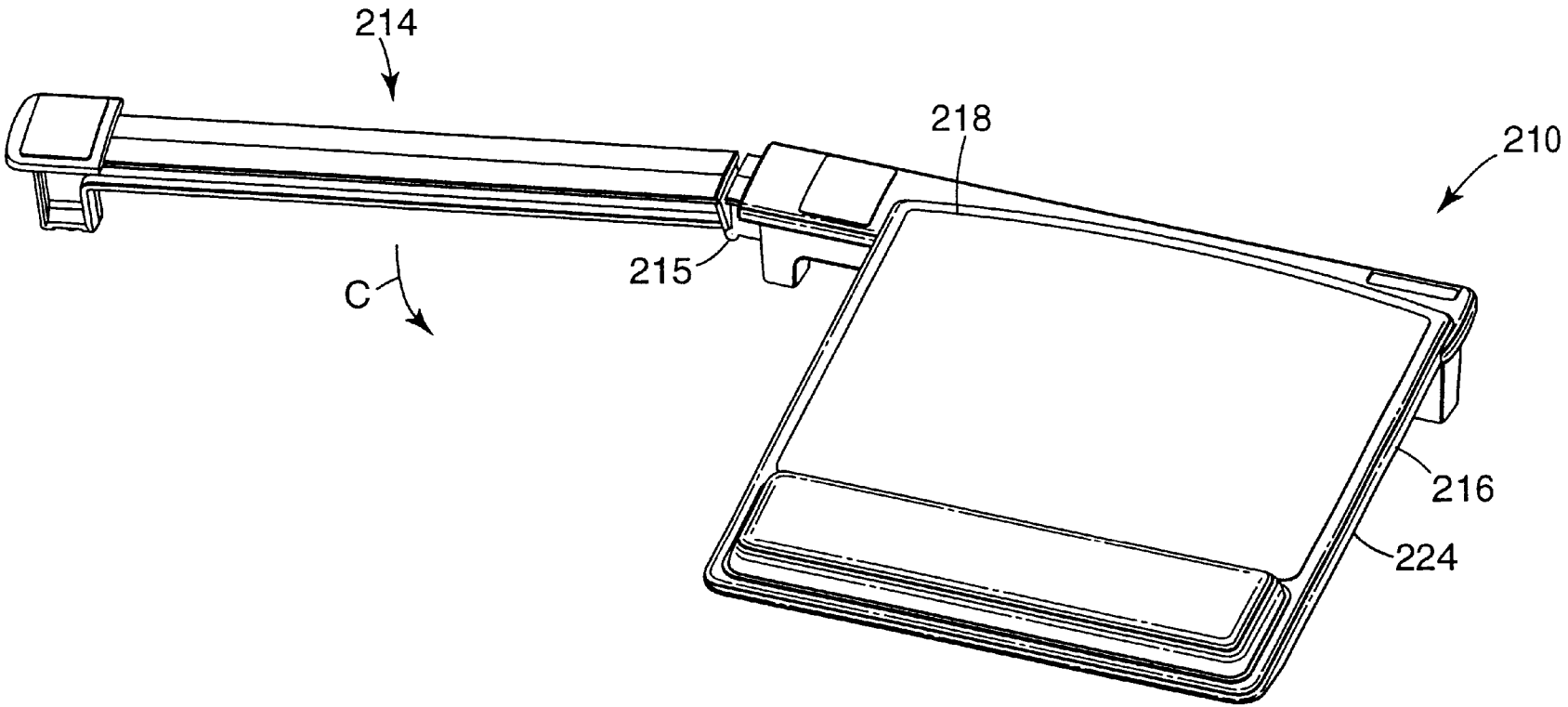
FIG. 7 is an isometric view of another embodiment of a collapsible computer platform assembly.

Another alternative embodiment of the adjustable arm assembly is shown in FIG. 7 as assembly 214 of platform assembly 210. In this embodiment, arm assembly 214 is hinged at a hinge 215 adjacent to a mousing platform 216 so that the entire arm assembly may be extended when in use, but may be rotated toward the mousing platform 216 in a general direction 'C' to make the assembly compact for storage. The rotation of arm assembly 214 is shown as being toward the second surface 224 of mousing platform 216, however, arm assembly 214 may. also be hinged so that it can rotate toward first surface 218 of mousing platform 216. Assembly 214 may also be provided with a hinge arrangement that allows the arm assembly 214 to rotate toward either surface 218 or surface 224 of mousing platform 216. Alternatively, a hinge arrangement could be provided that allows the assembly 214 to pivot or rotate such that the assembly 214 remains generally in the same plane as the mousing platform 216 (not shown).

While the above description includes several alternative arrangements of the adjustable arm assembly, many other arrangements are considered to be within the scope of the present invention. In addition, combinations of the above described embodiments are also possible, such as an arm assembly having multiple arm portions that slide relative to one another, while the entire arm assembly can also be hinged to rotate toward the mousing platform.

Because a majority of computer users manipulate the mouse with their right hand, each of the described embodiments of the platform assembly show the mousing platform on the right side of the arm assembly. However, the mousing platform may instead be on the left side of the arm assembly for those users who manipulate the mouse with their left hand. Left or right handed platform assemblies may be provided as different devices, where the user would select one of the two assemblies at the point of purchase. Alternatively, a single unit may be provided that can be assembled by the user with the arm assembly on either the left or the right side as desired, such as by snapping the arm assembly to the mousing platform in the desired configuration. This assembly could then be disassembled to position the arm assembly on the opposite side, if desired. It is further contemplated that the arm assembly may be convertible between left and right handed use. One way this may be accomplished is with a base portion attached to a mousing platform and a sliding arm that can slide through the base portion to either side of the mousing platform.

Referring again to FIGS. 2 and 3, mousing platform 16 is the component on which the user can manipulate the external mouse when using the computer. Thus, platform 16 is preferably generally planar and sized to be small enough to keep assembly 10 relatively compact, yet large enough to accommodate typical movement of a mouse by a user. Platform 16 is preferably made of a material that is fairly rigid so that platform 16 does not warp or bend easily either when in use or when it is being transported. In addition, the selected material should be sufficiently lightweight to minimize the weight of the assembly 10. One preferred material for platform 16 is a thermoplastic material, such as polystyrene. In addition, materials such as wood, sheet metal, and various laminates or composites can be used.

In this embodiment, a mousing surface 20 is provided to cover a portion of the first or top surface 18 of platform 16. Mousing surface 20 is preferably a textured surface, such as the microstructured surface provided on the Precise Mousing Surface, commercially available from the Minnesota Mining and Manufacturing Company of St. Paul, Minn. One such microstructured surface is described in U.S. Pat. No. 5,508,084 (Reeves et al.), commonly owned by the assignee of the present invention. This surface has a series of microstructured peaks and valleys that provide consistent contact with the trackball of an external mouse, thereby giving the user better control of the mouse. In the preferred embodiment, a sheet of the microstructured material is adhered or attached by some other attachment method to surface 18 of platform 16 to provide mousing surface 20. However, it is understood that a microstructured surface may actually be molded directly into or onto the top surface 18 to create the desired surface texture. It is further understood that some other material may instead be attached to surface 18, or that mousing surface 20 may be omitted from platform 16 so that a user would manipulate a mouse directly on surface 18.

Mousing platform 16 may further be provided with a wrist rest pad 22 so that a user's wrist can rest on a layer of comfortable material when using the mouse or when resting between periods of using the mouse. While this wrist rest pad 22 is optional, it is often desirable to have such a wrist rest to provide ergonomic benefits to the user. As best shown in FIG. 4, in one preferred embodiment, wrist rest pad 22 comprises a layer of cushioning material 56 sandwiched between surface 18 of platform 16 and a covering layer 58. Cushioning material 56 may comprise any of a number of support materials, such as gel, rubber, open-cell foam, closed-cell foam, liquid or particulate filled bags or pouches, or any other material suitable for supporting the wrists of a user. The cushioning material 56 may also be a combination of these or other suitable materials, depending on the preferences of the manufacturer and the user.

Surface 18 of mousing platform 16 could be used for a purpose other than manipulation of an external mouse. For one example, a user could manipulate a numeric keypad thereon, or could place papers on its surface to view while working with the computer.

The various components of platform assembly 10 are designed and arranged so that a computer may be positioned thereon at an angle that orients the keyboard at a desired typing angle and provides ergonomic advantages to the user. In the preferred embodiment, the mousing platform is preferably at an angle that ranges from 0 to 40 degrees with respect to the surface on which it is placed, is more preferably at an angle between 5 and 20 degrees with respect to the surface on which it is placed, and is most preferably between 10 and 15 degrees with respect to the surface on which it is placed.

The collapsible platform assembly 10 would typically be used by a person who is seated at a table or desktop so that they are positioned generally at eye level with the computer screen. However, the platform assembly may also offer benefits to an operator who is standing or substantially above the work surface on which the computer and computer platform assembly are placed. In this situation, the platform assembly could be configured so that the adjustable support arm assembly is attached to the bottom surface of the mousing assembly closer to the operator (or the edge nearest the wrist rest pad, when included). The platform assembly would then tilt in the opposite direction from that shown in FIG. 2, thereby providing "negative tilt" relative to the work surface.

Figure 8:
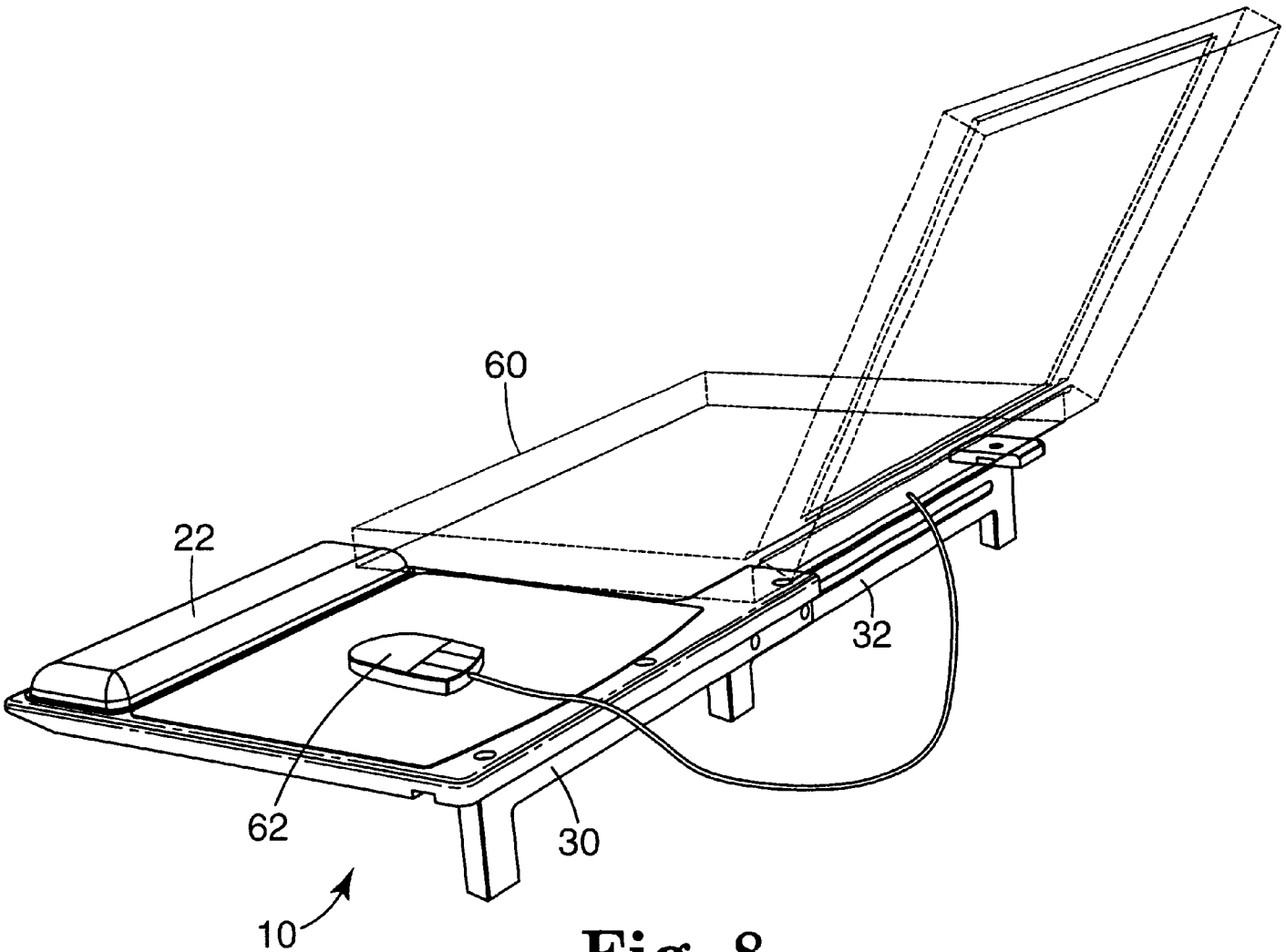
FIG. 8 is an isometric view of the rear of a collapsible computer platform assembly with a notebook computer positioned thereon.

FIG. 8 illustrates a notebook computer 60 and external mouse 62 positioned above a base surface, such as a table, on the platform assembly 10 of the type shown in FIGS. 2 and 3. As shown, sliding arm 32 is extended for receiving the bottom surface of a notebook computer. To properly position the computer on the assembly 10, the bottom of the computer 60 near its top edge should be placed so that it rests at least partially on the sliding portion 32. Depending on the configuration of the assembly 10, the bottom side of the computer may also be resting on base portion 30. In either case, the bottom side of the computer near its bottom edge will then rest on the base surface, such as a table where the assembly 10 is placed, thereby positioning the computer at an angle relative to the base surface. During computer use, the user can place the heel of their hands on the base surface when using the keyboard and on the wrist rest pad 22 to manipulate the mouse, as desired.

While one preferred embodiment of support arm assembly 14 is described above, other assemblies that would extend to support a notebook computer and retract for storage of the platform assembly are within the scope of the present invention. For one example, in an alternative embodiment shown in FIG. 9, a collapsible platform assembly 310 includes two adjustable support arm assemblies 314 and 314' and a mousing assembly 312 having a mousing platform 316. Support arm assemblies 314, 314' may be similar to those described above with respect to FIGS. 2 and 3 that move in a direction 'A' to retract or extend. In this particular example, when a notebook computer is placed on assembly 310, the area of the bottom surface of the computer near its top edge would rest on the sliding arm 332 and the area of the bottom surface of the computer near its bottom edge would rest on the sliding arm 332'. An additional support member 331 may connect the arms 332, 332' to make it easier to extend or retract both arms at the same time and to give the assembly 310 additional rigidity. However, support member 331 is not necessary for proper use of assembly 310.

Figure 9:
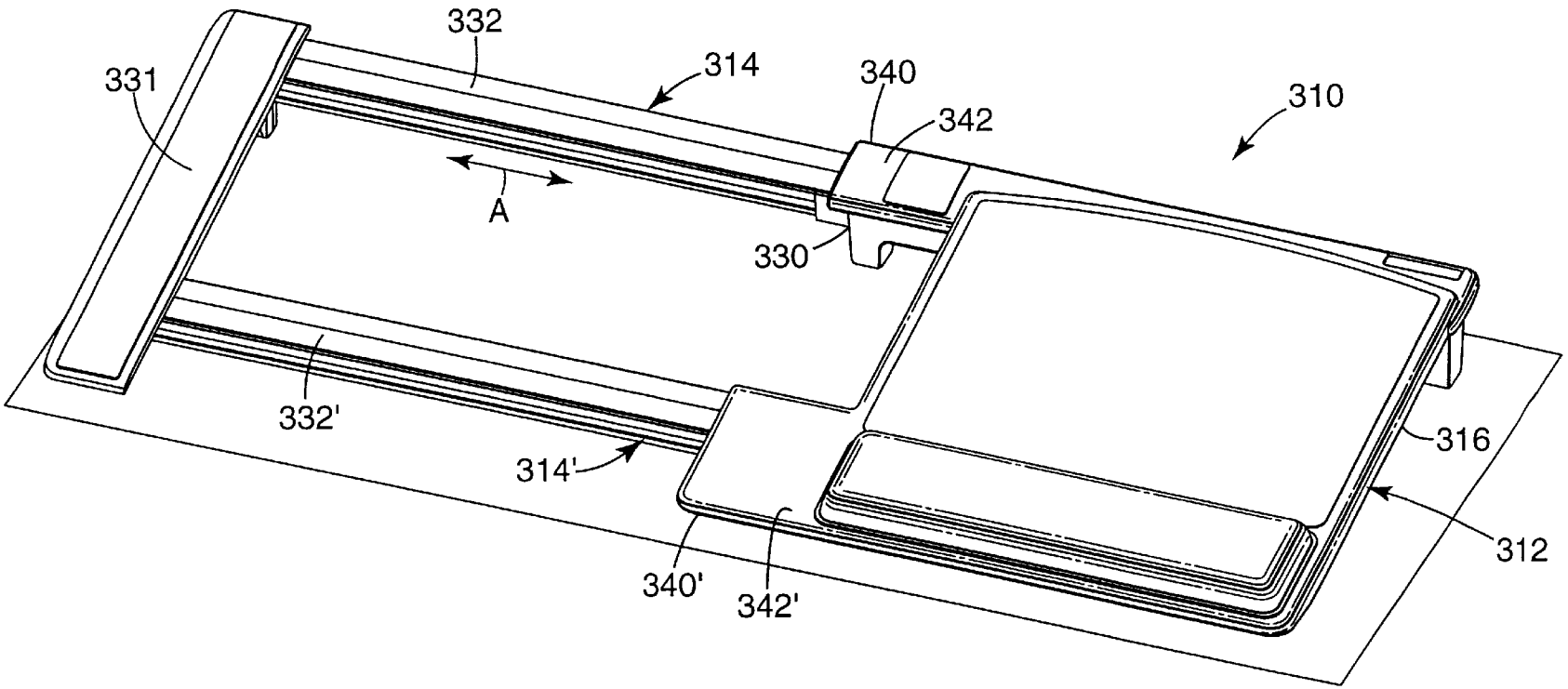
FIG. 9 is an isometric view of an alternate embodiment of a collapsible computer platform assembly of the present invention having multiple support arms.

As shown in FIG. 9, mousing platform 316 includes base portion 330, extension portions 340 and 340' having top surfaces 342 and 342', respectively. When a computer is placed on assembly 310, the top right corner of the computer may rest on top surface 342 of extension portion 340, while the bottom right comer of the computer may rest on top surface 342' of extension portion 340'. Alternatively, portions 340 and 340' may be provided as one continuous member to provide a continuous surface on which the right side of the computer can rest.

The present invention has now been described with reference to several embodiments thereof. The entire disclosure of any patent or patent application identified herein is hereby incorporated by reference. The foregoing detailed description and examples have been given for clarity of understanding only. No unnecessary limitations are to be understood therefrom. It will be apparent to those skilled in the art that many changes can be made in the embodiments described without departing from the scope of the invention. For instance, the computer platform may be provided with document holders or other peripheral devices that can be easily attached to and detached from various positions on the device. Are also contemplated. Thus, the scope of the present invention should not be limited to the structures described herein, but only by the structures described by the language of the claims and the equivalents of those structures.

What is claimed is:

1. A collapsible platform assembly, comprising:

a platform having a first surface and an opposite second surface; and a support arm assembly for supporting the bottom surface of a computer, the support arm assembly comprising at least one base portion extending from the second surface of the platform and at least one adjustable arm assembly connected to and laterally extensible from the at least one base portion and wherein the support arm assembly further comprises at least one leg extending from at least one of the adjustable arm assembly and the base portion.

2. The platform assembly of claim 1, wherein the at least one adjustable arm assembly is slideably connected to the base portion.

3. The platform assembly of claim 1, wherein the at least one adjustable arm assembly is rotatable relative to the platform.

4. The platform assembly of claim 1, wherein the first surface of the platform further comprises a mousing surface.

5. The platform assembly of claim 1, wherein the first surface of the platform further comprises a wrist rest pad.

6. The platform assembly of claim 1, wherein the at least one leg is adjustable.

7. The platform assembly of claim 1, wherein the at least one leg is rotatable relative to the support arm assembly.

8. The platform assembly of claim 1, wherein the platform further comprises an extension portion including at least one skid-resistant pad, and wherein the adjustable arm assembly further comprises a support plate including at least one skid-resistant pad.

9. The platform assembly of claim 8, wherein the at least one skid-resistant pad of the extension portion and the at least one skid-resistant pad of the support plate are generally coplanar.

10. The platform assembly of claim 1, wherein the adjustable arm assembly further comprises a first arm that is slideable relative to the at least one base portion and a second arm that is slideable relative to the first arm.

11. A collapsible platform assembly, comprising:

a platform having a first surface and an opposite second surface; and a support arm assembly for supporting the bottom surface of a computer, the support arm assembly comprising a first base portion extending from the second surface of the platform, a second base portion spaced from the first base portion and extending from the second surface of the platform, a first adjustable arm assembly connected to the first base portion, a second adjustable arm assembly connected to the second base portion, and at least one support member connected to the first and second adjustable arm assemblies.

12. The collapsible platform assembly of claim 11, wherein the first adjustable arm assembly, the second adjustable arm assembly, and the at least one support member are rotatable relative to the platform.

13. A method of supporting a portable computer at an angle relative to the surface on which the computer is placed, comprising the steps of:

providing a collapsible platform assembly for supporting a portable computer, the assembly comprising a platform having a first surface and an opposite second surface, and a support arm assembly for supporting the bottom surface of a computer, the support arm assembly comprising at least one base portion extending from the second surface of the platform and at least one adjustable arm assembly connected to the at least one base portion and wherein the support arm assembly further comprises at least one leg extending from at least one of the adjustable arm assembly and the base portion.

providing a portable computer; and positioning the portable computer on the platform assembly so that a bottom surface of the computer rests on at least a portion of the adjustable arm assembly.

* * * * *

UNITED STATES PATENT AND TRADEMARK OFFICE

CERTIFICATE OF CORRECTION

PATENT NO. : 6,511,039 B1
DATED : January 28, 2003
INVENTOR(S) : James E. Nash

It is certified that error appears in the above-identified patent and that said Letters Patent is hereby corrected as shown below:

Column 6,
Line 23, delete "." following "may".

Signed and Sealed this

Twenty-ninth Day of July, 2003

JAMES E. ROGAN
*Director of the United States Patent and Trademark Office*